United States Patent [19]

Chervalier

[11] Patent Number: 4,706,441

[45] Date of Patent: Nov. 17, 1987

[54] ROTARY VACUUM BAGGING DEVICE EQUIPPED WITH SHAPING AND COMPACTING BOXES

[76] Inventor: Lucienne Chervalier, GEC 5 rue Denis Papin, Verneuil l'Etang 77390, France

[21] Appl. No.: 920,807

[22] Filed: Oct. 17, 1986

[30] Foreign Application Priority Data

Oct. 21, 1985 [FR] France ..... 85 15586

[51] Int. Cl.[4] ..... B65B 31/06; B65B 51/14; B65B 1/06; B65B 1/22

[52] U.S. Cl. ..... 53/512; 53/266 R; 53/268; 53/525; 53/527; 53/570

[58] Field of Search ..... 53/512, 113, 527, 266 R, 53/267, 268, 272, 276, 570, 525

[56] References Cited

U.S. PATENT DOCUMENTS

| | | | |
|---|---|---|---|
| 3,006,120 | 10/1961 | Grafingholt | 53/512 X |
| 3,058,274 | 10/1962 | Christensson | 53/512 |
| 3,103,771 | 9/1963 | Grafingholt | 53/512 X |
| 4,027,456 | 6/1977 | Wilson | 53/512 X |
| 4,174,599 | 11/1979 | Callet et al. | 53/512 |
| 4,418,513 | 12/1983 | Plahm | 53/512 X |
| 4,510,733 | 4/1985 | Hansen et al. | 53/570 X |
| 4,538,399 | 9/1985 | Muller | 53/512 |
| 4,580,393 | 4/1986 | Furukawa | 53/512 |
| 4,586,320 | 5/1986 | Takai et al. | 53/512 |

*Primary Examiner*—Horace M. Culver
*Attorney, Agent, or Firm*—Kramer, Brufsky & Cifelli

[57] ABSTRACT

A continuously operating automatic vacuum bagging device equipped with shaping and compacting boxes and with a bag-holder chute is characterized by a rotating platform carrying a vertical turntable and a number of shaping and compacting boxes equal to the number of working positions. Each position is intended to carry out a complete packaging operation, including the placement of a bag on a chute, its filling and the compaction by vibration, its placing on the vacuum, and its closure.

2 Claims, 22 Drawing Figures

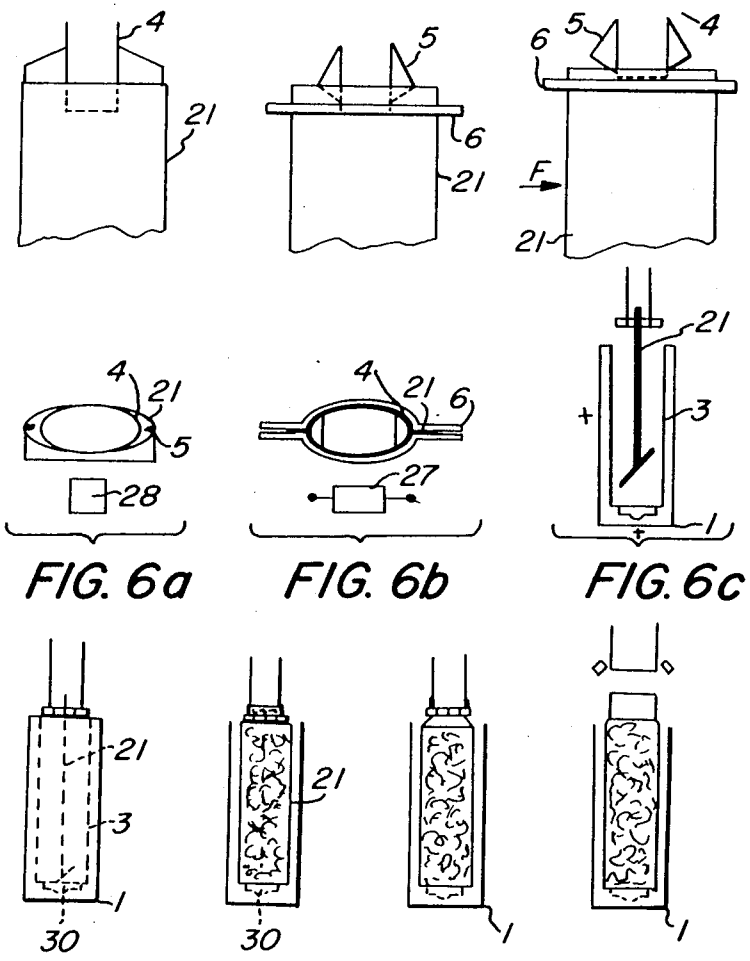
FIG. 6a FIG. 6b FIG. 6c FIG. 6d FIG. 6e FIG. 6f FIG. 6g
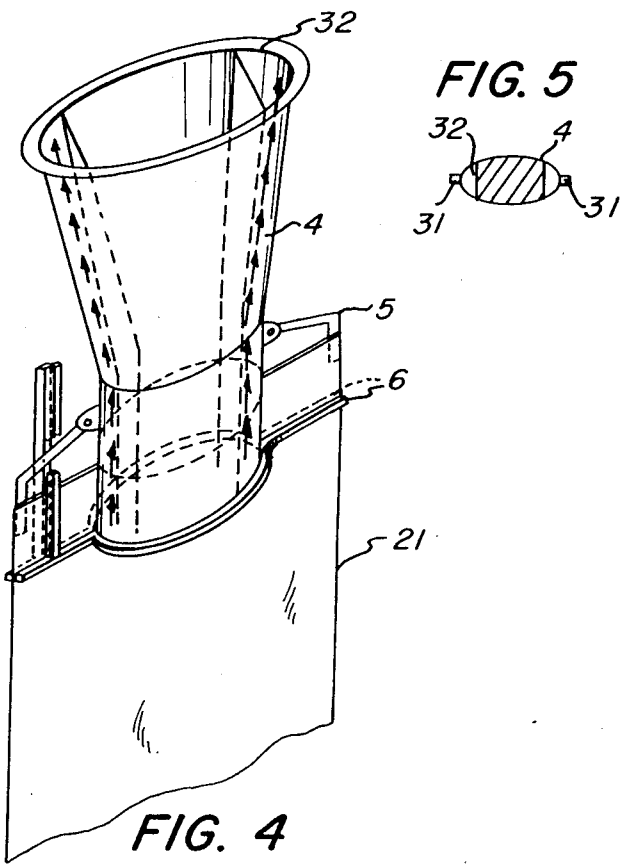
FIG. 5
FIG. 4

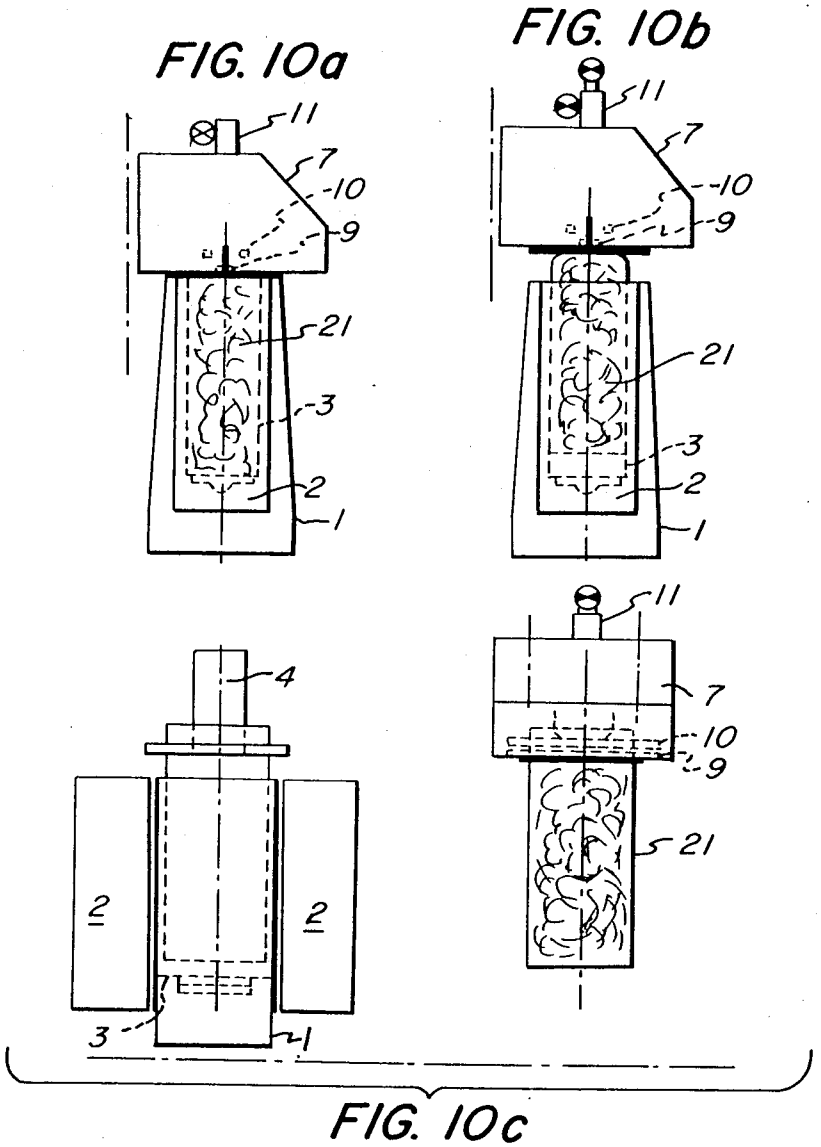
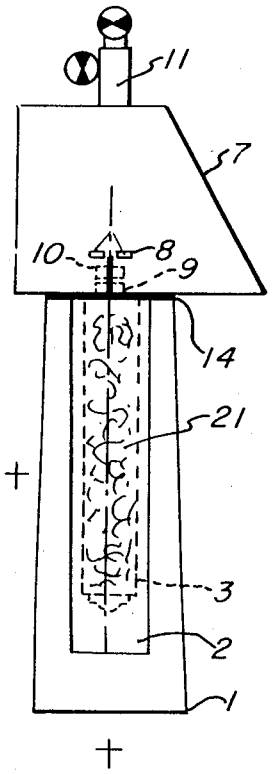
FIG. 9

ROTARY VACUUM BAGGING DEVICE EQUIPPED WITH SHAPING AND COMPACTING BOXES

TECHNICAL FIELD

The present invention relates to vacuum bagging machines and more particularly, to a new rotary or linear device equipped with a compacting box and a bag-holder chute intended to carry out continuously the different operations of vacuum bagging by means of shaping and compacting boxes and evacuation hoods used to compact and shape the packaging bag and its contents, which have been degassed if necessary.

BACKGROUND OF THE INVENTION

Automatic vacuum bagging devices of the prior art are generally used to preserve hygroscopic powdered, granulated, or crushed material, perishable in air or moisture, under the best conditions and in the smallest volume.

Up to now, different types of vacuum packaging have been used, which were generally organized around an articulate chute carrying the bag and controlled by a set of jacks. The bag, hooked to this chute, was placed in a vacuum during the bagging operation by means of an external pump, connected to openings provided on the walls of the chute.

This arrangement served, on the one hand, to evacuate the air contained in the bag and, on the other hand, to facilitate the operation of compaction obtained by means of a vibrator located on the floor of the shaping compactor, on which the bag rested.

All of these arrangements were characterized by a reservoir of materials to be packaged, provided in its lower part with a flexible or rigid sleeve that could be closed if necessary. The packaging bag was connected to the sleeve by means of a rigid or articulated chute, whose opening was controlled by a set of two hammers driven by jacks. The upper part of the bag fixed to the chute was protected from all pollution by means of sealing strips connected to each other in order to flatten the top of the bag against the outer walls of the chute.

After the operations of filling and deaeration obtained by means of an attached pumping circuit, the product was compacted by means of a vibrator placed under the platform carrying the bag. The bag, the vibrator, and the platform were placed within a rigid box installed inside two shelves mounted on a slide rail, so as to open in the manner of a jaw, and closing on the lower part of the chute.

On the upper part of the box were found two parallel bars controlled by a set of jacks and springs, which could rip the upper part of the bag located under the chute at two different pressures, depending on whether a vacuum packaging was being carried out or a simple deaeration of powdered materials capable of closing a closing-off of the circuits.

During certain bagging operations, the shaping box closed on the bag at the level of the chute and was made tight by means of a gasket placed permanently between the two shelves. The box was then placed under reduced pressure by means of another external pumping arrangement, in order to accelerate the operation of filling of the bag, compaction of the product contained, and its shaping, thus increasing the packaging speed.

Other arrangements used more rudimentary bagging techniques, carried out by means of a turntable intended to distribute the materials to be packaged into different bags in a continuous manner by means of a chute and a hopper.

All of these types of arrangements showed numerous advantages, in particular:

- minimum space occupied
- moderate cost of the bagging installation
- good quality of packaging.

On the other hand, this technology showed numerous disadvantages, particularly during use of the articulated chute:

- a tricky or even difficult working, requiring a particular adaptation for each product,
- a rapid fouling of the circuit of deaeration and flow of the materials to be packaged,
- discontinuous operation,
- a low yield with a limiting speed,
- in the case of the use of the arrangement with a rotary turntable, it was difficult to carry out a deaeration of the contents of the bag and its compaction simultaneously,
- air pollution was also created when powdered materials generating an aerosol were used.

SUMMARY OF THE INVENTION

An object of the present invention is to provide a new continuous vacuum bagging device equipped with shaping and compacting boxes and with bag-hanger chutes.

According to the present invention, a new continuous vacuum bagging device with shaping and compacting boxes is characterized by a moveable platform including four working positions, equipped with shaping and compacting boxes with a side door, a vibrating shaper, slide rails and gaskets, a metal chute, a bag-hanger, moveable sealing strips, a moveable evacuation hood, connected to a pump, stretchers for cleaning the top of the bag, compacting bars for the top of the bag, and a bag welding device.

The present invention characterized in this way shows numerous advantages and in particular:

- an optimal yield
- easy working
- high durability for a reliable operation
- a perfect tightness with respect to the surrounding atmosphere
- a low cost/profit ratio.

BRIEF DESCRIPTION OF THE DRAWINGS

The invention will be better understood as a result of the attached drawings, which are presented for a non-limiting preferential embodiment.

FIGS. 4 and 5 together illustrate in perspective a bag-holder chute and filling system provided according to the present invention.

Figure 3:
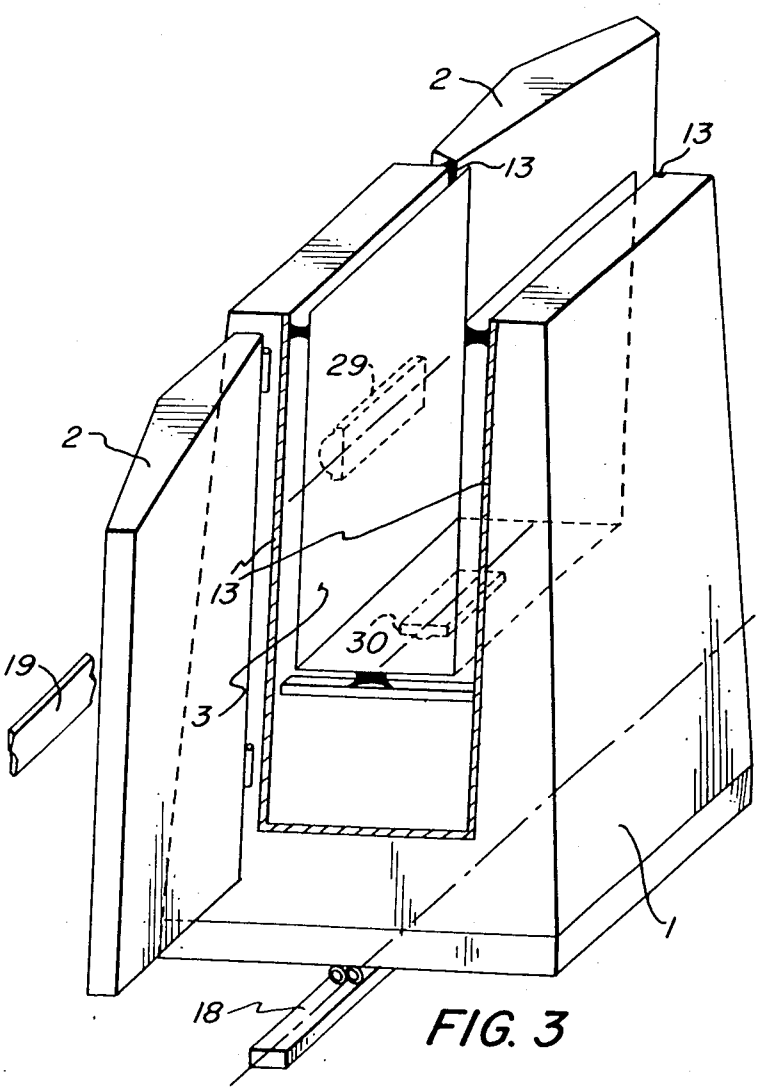
FIG. 3 is an illustration showing a shaping and compacting box provided according to the present invention.

FIGS. *6a*, *6b*, *6c*, *6d*, *6e*, *6f*, and *6g* show partially in section and partially in perspective the operation of the chute and of the shaping and compacting box of FIGS. 3 and 4.

FIGS. 7, 8, 9, and 10 together illustrate in section the operation of an assembly of the shaping and compacting box and the evacuation hood of FIG. 3.

Figure 11B:
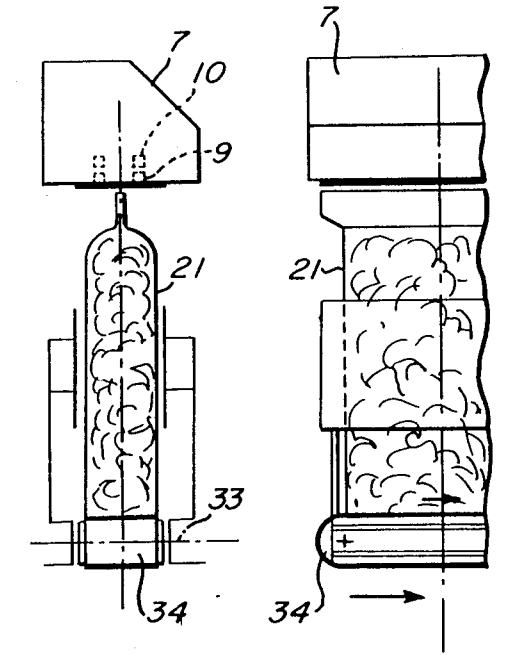
Figure 11A:
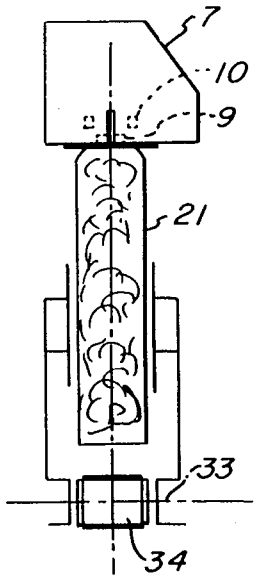

FIGS. 11*a* and 11*b* illustrate in section the operation of evacuation of a bag in the device after being filled and placed on a vacuum.

Figure 12B:
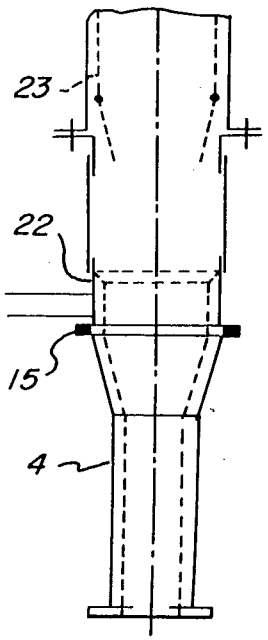
Figure 12A:
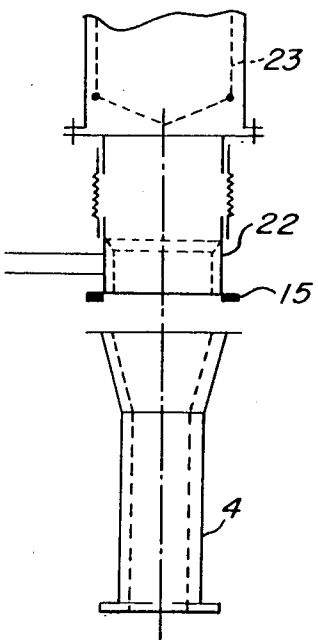

FIGS. 12*a* and 12*b* illustrate in section a joint placed on the chute of FIG. 4.

DESCRIPTION OF THE PREFERRED EMBODIMENT

Figure 1:
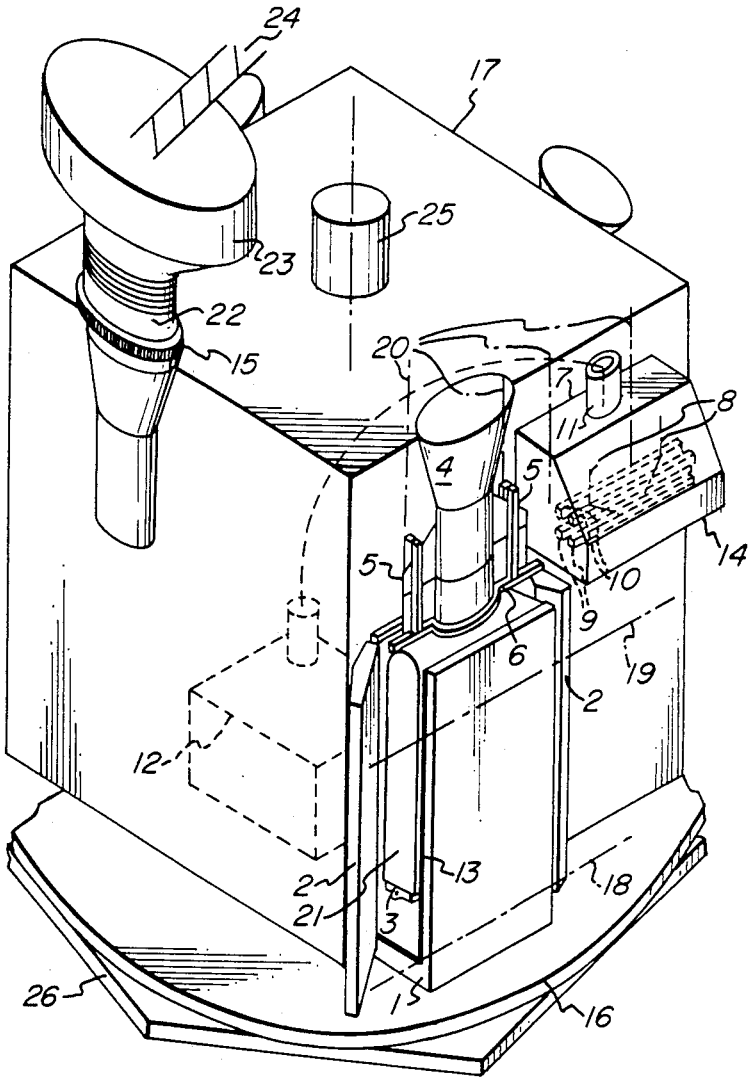
FIG. 1 is an illustration of a perspective view of a vacuum bagging device provided according to the present invention.

FIG. 1 shows the assembly of a rotary vacuum bagging device 1A provided according to the present invention equipped with the shaping and compacting box and bag-holder chute. The tower of the turntable 17 is mounted on a rotating platform 16, driven in its movement by a motor not shown in this drawing. On this turntable 17 are found four working positions, each equipped with a shaping and compacting assembly 1B. Each assembly has an outer rigid box 1 equipped with a side door 2 containing a shaping compacting box 3. Each shaping and compacting assembly is topped by a chute 4 equipped with a bag-holder 5 and sealing strips 6. A bag 21 placed in the box moves therewith on slide rails 18 integral with the platform 16 to arrive, at the end of the operation, in a position under an evacuation hood 7 provided with stretchers 8 for cleaning the top of the bag and with a set of compacting bars 9 exerting a strong pressure during the welding of the bag, obtained by another compacting bar 10. A pipe 11 makes it possible to connect the evacuation hood 7 to a suction pump 12 located inside the turntable tower. The tightness of the box is obtained by means of the door 2 flattened against a gasket 13 integral with the box.

Tightness between the evacuation hood, which is vertically moveable on slide rails 20, and the box is ensured by gasket 14. The elements making it possible to ensure the movements of the box 1, the chute 4, and the evacuation hood 7 are pressure cylinders not shown here.

During all of these operations, the bag 21 is placed in the shaping compactor 3 and is hooked to the chute 4 by means of the bag-holder 5. Under these bag-holders are found the sealing strips 6 which open when the bag is filled. Tightness between the bag and the chute is ensured by a telescopic device 22 provided with a gasket 15 in its lower part. Above this device 22, a weighing system 23 feeds the product to be packaged into the bag 21. This product is directed by an endless screw 24 placed above the weighing system 23.

The electrical connections necessary for the supply of the motors driving the assembly of the device whose control is provided by an external control board are obtained by an electric rotary joint 25, one of whose parts is integral with the tower 17 while the fixed part is connected to the framework 26. The supply of compressed air is also obtained by a classical rotary joint.

Figure 2:
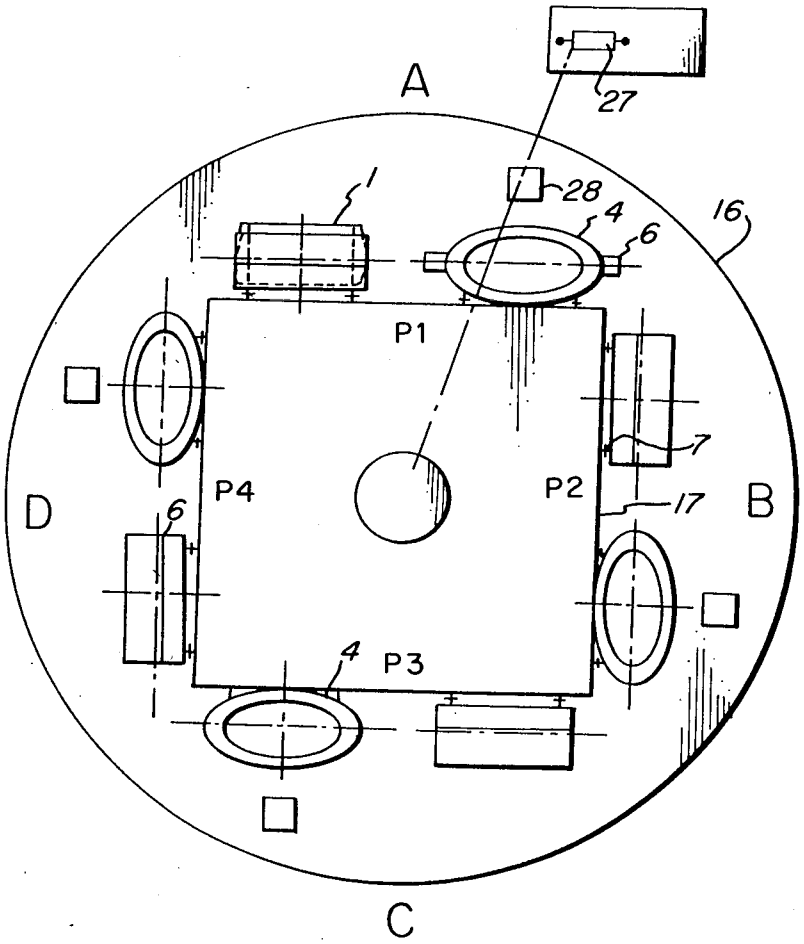
FIG. 2 is an illustration of a top view of the vacuum bagging device of FIG. 1.

FIG. 2 shows a top view of the vacuum bagging device of FIG. 1 in order to show the four working positions, which operate simultaneously.

Before the device is put into operation, the four boxes 1 are located under the evacuation hood 7. The boxes have the side doors 2 open, the shaping compactors 3 are motionless, and the telescopic joint 22 is in the upper position. The weighing system 23 has received a predetermined amount of the substance to be bagged.

In the position P1 of the level A (FIG. 2) there is placed the packaging bag 21 whose upper part is kept open automatically or manually below the chute 4. Action on pedal 28 causes the emergence of hooks or clamps 5 on which the bag 21 is hung. By operating the jacks (not shown), which control the sealing strips 6, by means of compressed air or manually 27, the bag is flattened on the chute over its whole periphery. The strips perfectly follow the outer shape of the rigid chute 4 with the top of the bag 21 as joined.

After these operations are completed, the platform 16 turns, moving the assembly to the position P2. At this working position, the vacuum hood 7 is kept in the upper position, the box 1 has its side doors which close, thus enclosing the bag 21 within the shaping box 3.

At the working position P3, the bag receives the materials to be bagged by means of the chute 4 connected to the weighing device by the telescopic joint 22, which comes down and flattens itself against the part of the chute 4. This operation releases the flow of a preweighed volume of material into the bag 21. After the filling is completed, the telescopic joint 22 rises and the bag 21, placed in the compacting shaper located on the rotating platform 16, undergoes a rotation toward the last position P4 at level D (FIG. 2.)

At the position P4, the vibrator of the shaping compactor stops, the sealing strip 6 opens, thus releasing the top of the bag from the chute 4. The assembly of box 1, shaping compactor 3 closed by its tightness doors, and the bag are placed under the evacuation hood 7. The latter, which is moveable vertically, moves down and adheres to the top of the box 1, thus forming a tight assembly as a result of the gasket 14. As soon as the evacuation hood has touched the shaping and compacting box 3, pumping starts until a satisfactory vacuum of the bag is obtained. At this moment of the operation, as a result of electrical or manual commands, the cleaning stretchers 8 emerge and remove dust from the top of the bag, while a set of high-pressure compacting bars 9, controlled by jacks, closes the bag and causes a welding by thermo-compression; after the welding is completed, the compacting strips open, the evacuation hood 7 rises, and the shaping and compacting box 3 releases the bag 21.

Since the operations of placing of the bag, bagging, compaction, evacuation, and welding are simultaneous as soon as the position P1 is freed, a new bag is immediately hooked to undergo the same operations. The whole constitutes a continuous bagging system where the working positions are continually supplied. The simultaneity cf the working positions is obtained by means of electrical commands which manage the continuity of the operations and ensure the automatic operation of the assembly.

According to an important characteristic of the invention, FIG. 3 shows the shaping and compacting box of FIG. 1 used for the conveyance and shaping of the bag.

This shaping and compacting box 1A is made up of a rigid outer box 1, equipped with two side doors 2, which close on a gasket 13.

Within this box is found the shaping compactor 3 formed by a parallelepiped without side walls and top, which rests on mechanical vibrators 30 and rubber blocks 29. This shaping and compacting box, which receives the packaging bag 21, moves horizontally on slide rails 18 and 19 during the bagging operations.

According to another characteristic of the invention, FIGS. 4 and 5 together show partially in perspective and partially in section bag-holder chute and filling system.

The chute 4 has the shape of a truncated cone of oval section, whose side ends 32 constitute independent vents permitting the evacuation of air during filling of the bag. In the lower part of this chute are located articulated arms, which spread apart conventionally upon command and constitute the bag-holders 5. Below these bag-holders, the compacting bars 6 follow exactly the oval shape of the chute in order to obtain a good tightness against dust. These compacting bars 6 form with the chute, at the right ends, clamps 31 permitting the assurance of a perfect tightness.

FIGS. 6*a*, 6*b*, 6*c*, 6*d*, 6*e*, 6*f*, and 6*g* show partially in section and partially in perspective the operation of the chute and the shaping and compacting box of FIG. 1.

Referring to FIG. 6*a*, we find bag 21 attached to the chute 4 and, by operating pedal 28, the bag-holders 5 become taut, keeping the bag under the chute.

In FIG. 6*b*, the manual control symbolized by pedal 27 makes it possible to operate the sealing bars 6 which cause the flattening of the top of the bag 21 against the bottom of the chute 4, automatically involving the extension of the bag-holder arms 5.

The securement of the bag 21 to the chute 4 and the positioning of the bag 21 in the box 1 within the shaping compactor 3 are shown in FIG. 6*c*.

FIGS. 6*d* and 6*e* show the positioning of the bag 21 in the shaping compactor 3 which rests on vibrators 30.

As soon as the filling of the bag starts, the vibrators start to operate. During all of these operations, the doors 2 of the rigid box 1, not shown in these drawings, have been closed, in order to ensure a good conformity of the bag.

FIGS. 6*f* and 6*g* show the operation of the end of filling of the bag which, as soon as it is finished, stops the vibrators 30 of the compactor; from this moment on, the sealing strips 6 open, releasing the bag from the chute 4, which rises. The bag assembly 21, enclosed in the compacting box, at this moment slides toward the evacuation hood.

FIGS. 7, 8, 9 and 10 are in section, and together show the operation of the whole of a vacuum bagging device provided according to the present invention.

Figure 7:
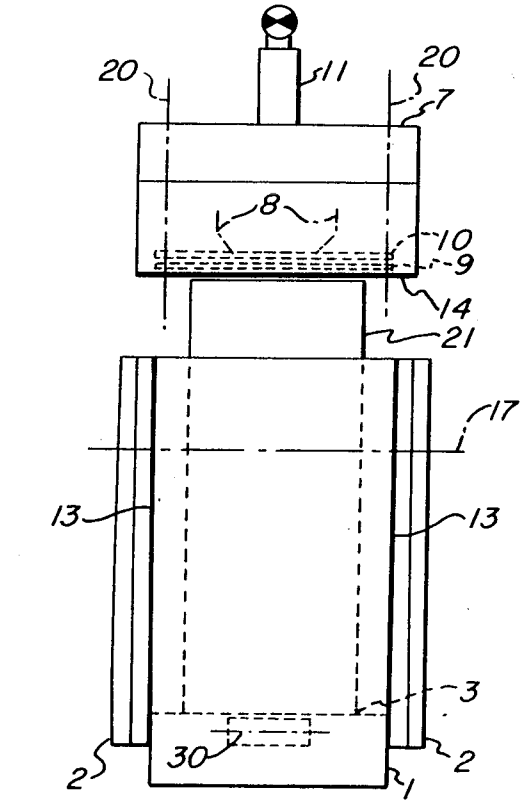

Referring to FIG. 7, the bag 21, filled with compacted material, is placed in the compacting box 3, with the doors 2 flattened against the gaskets 13. The cleaning stretchers 8, consisting of metal scrapers, are returned. The evacuation device 7 is in the raised position, connected to the pumping device by the pipe 11. The compacting bars 9 and 10, mounted on slide rails, are in the separated position. The gasket 14, adhered to the bottom of the hood 7, is face to face with the top of the open conforming and compacting box.

Figure 8:
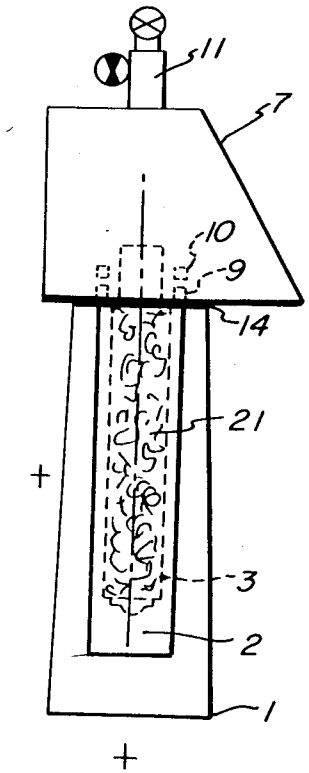

In FIG. 8, the hood 7 has been vertically displaced to be located at the top of the shaping and compacting box 3, ensuring a tight enclosure by means of the gasket 14. The evacuation of the assembly is obtained by means of a pumping system connected to piping 11. The top of the bag 21 is completely open while the compacting bars 9 and 10 are still separated.

FIG. 9 shows the assembly of the device placed on the vacuum. Cleaning arms 8 are moved in a conventional fashion to clean and stretch the top of the bag. When this latter operation is complete, the high-pressure compacting bars 9 start to grip the top of the bag, the arms of the cleaning stretchers 8 are removed, while the welding bars simultaneously close on the top of the bag to carry out the final closure of the bag.

The operations of release of the bag are shown in FIGS. 10*a*, 10*b*, and 10*c*.

In FIGS. 10*a* and 10*b*, with the bag on the vacuum 21 completely closed by a weld, the bars 10 separate. The return to atmospheric pressure of the enclosure is obtained by the opening of a solenoid valve, thus permitting the hood 7 to rise from the shaping and compacting box 3. The side doors 2 of the rigid box open and the completely packed bag 21 can be recovered manually, held by the compacting bars 9, according to the drawing in FIG. 10*c*.

FIGS. 11*a* and 11*b* show in section the operation of recovery of the bag 21. The latter, held by the compacting bars 9, has slid on a conveyor belt 34, while side plates, in a horizontal movement, by means of a telescopic system, hold the bag in a vertical position. At this moment, the compacting bars 9 separate and completely release the bag from the assembly of the device.

Referring to FIG. 12*a* and FIG. 12*b*, a telescopic joint 22 connects the chute 4 to the metering member 23. In FIG. 12*a*, the telescopic joint 22 is in the upper position, provided with a sealing washer 15 at its base.

When the bag 21 is under the chute 4, the telescopic joint 22 descends and lies flat against the top of the rigid chute 4, ensuring tightness. The materials flow from the weighing device 23 into the bag, while the air contained in the latter escapes through the vents 32, as shown in FIG. 12*b*.

Similarly, although the invention has been described with respect to a best mode embodiment thereof, those skilled in the art will note that additions, deletions or substitutions thereto can be made therein consistent with the spirit and scope of the invention.

I claim:

1. A vacuum bagging device for continuously performing the functions of positioning, evacuating, filling and sealing a bag having an opening with material, comprising:

moveable platform;

tower means disposed on said platform for defining a plurality of work positions;

a plurality of chute means, each positioned at one of said tower work positions for locating the bag opening and guiding the material thereto;

a plurality of evacuation hood means, each positioned at one of said tower work positions to cooperate with said chute means for selectively evacuating the bag;

a plurality of shaping and compacting boxes positioned on said platform relative to said tower work positions to receive the bag, each of said shaping and compacting boxes having opposed side doors and having slide rails enabling said shaping and compacting box to move between a corresponding one of said chute means and said evacuating hood means;

vibration means positioned within said shaping and compacting boxes for compacting the material in the bag;

vacuum means communicating with said evacuation hood means for evacuating said bag after the material has been provided;

cleaning stretcher means positioned on said tower work position for removing dust from the top of the bag;

high pressure compacting means selectively positioned on said tower work position for closing and thermo-compressively welding the bag after the air and dust have been removed therefrom.

2. The device of claim 1 wherein said moveable platform has a major surface and rotates about an axis perpendicular thereto.

* * * * *